United States Patent [19]

Hutchison et al.

[11] 3,960,211

[45] June 1, 1976

[54] GAS OPERATED HYDRAULICALLY ACTUATED WIRE LINE PACKER

[75] Inventors: Stanley O. Hutchison, Bakersfield; Neal L. Mitchell, Taft, both of Calif.

[73] Assignee: Chevron Research Company, San Francisco, Calif.

[22] Filed: Sept. 30, 1974

[21] Appl. No.: 510,264

[52] U.S. Cl. ..... 166/187; 166/64

[51] Int. Cl.[2] ..... E21B 33/127; E21B 23/04

[58] Field of Search ..... 166/250, 255, 187, 63–65, 166/122; 277/70, 74, 103

[56] References Cited

UNITED STATES PATENTS

| | | | |
|---|---|---|---|
| 2,050,128 | 8/1936 | Schlumberger | 166/253 |
| 2,399,766 | 5/1946 | Steward | 166/65 R |
| 2,645,289 | 7/1953 | Leas | 166/64 X |
| 2,815,816 | 12/1957 | Baker | 166/63 |
| 2,935,615 | 5/1960 | True | 166/187 X |
| 2,978,029 | 4/1961 | O'Reilly et al. | 166/187 X |
| 3,066,739 | 12/1962 | Saurenman et al. | 166/187 X |
| 3,138,207 | 6/1964 | Peppers | 166/187 X |
| 3,364,993 | 1/1968 | Skipper | 166/250 |
| 3,478,584 | 11/1969 | Strubhar et al. | 166/250 X |
| 3,578,079 | 5/1971 | Alexander | 166/187 |

*Primary Examiner*—Stephen J. Novosad
*Attorney, Agent, or Firm*—R. L. Freeland, Jr.; Edward J. Keeling

[57] ABSTRACT

A self-contained wire line inflatable packer useful to carry an impression sleeve into a well for making impressions of the well surface, the inflatable sleeve of the wire line packer being automatically sequentially inflated and deflated by a valve controlled by a sequencing timer actuating means driven by an operating gas.

10 Claims, 22 Drawing Figures

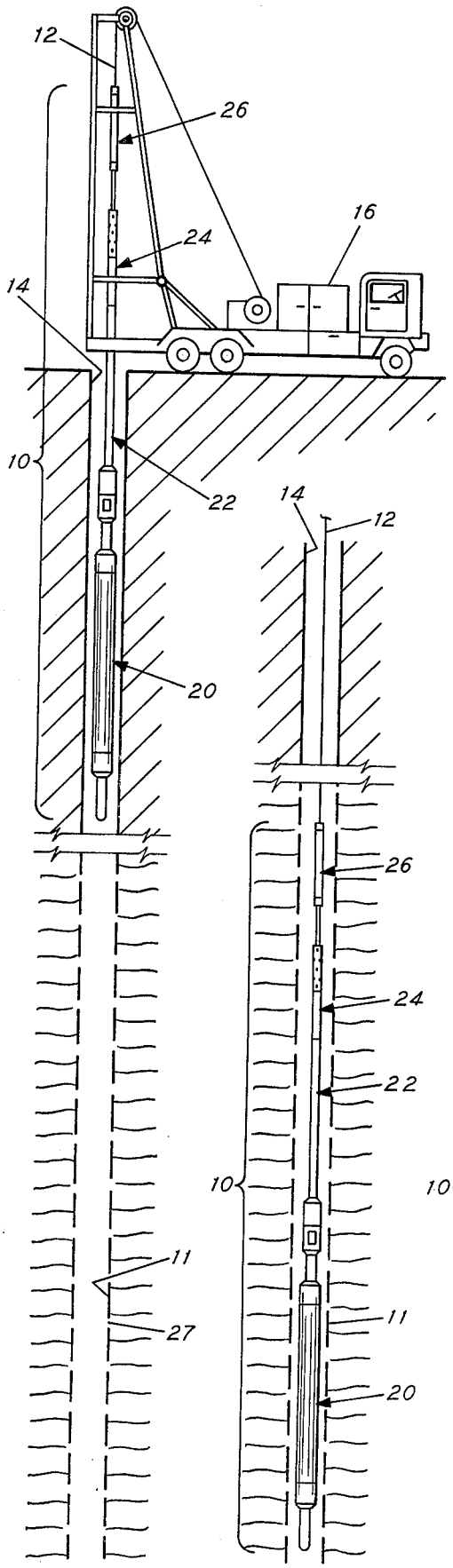
FIG. 1
FIG. 2
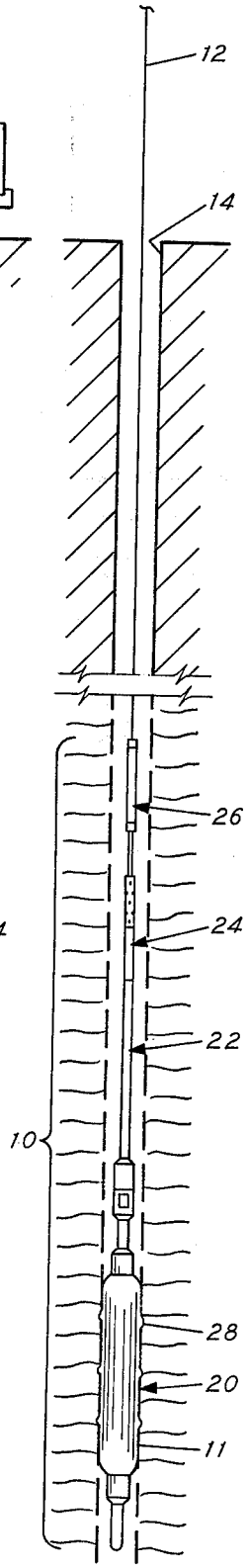
FIG. 3
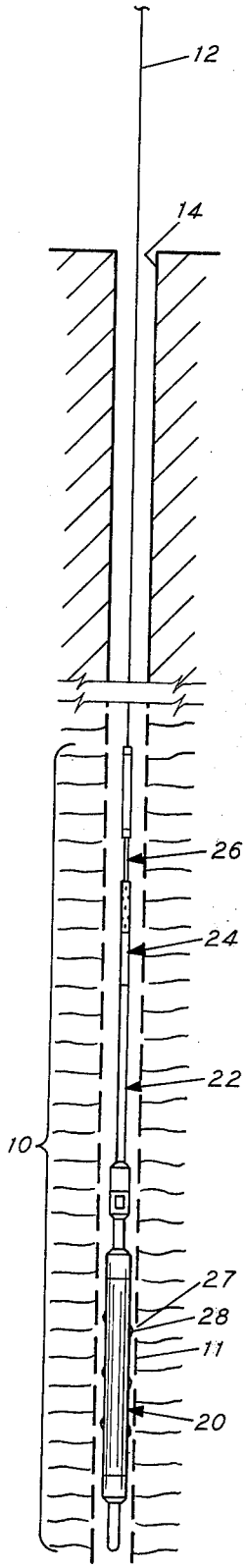
FIG. 4
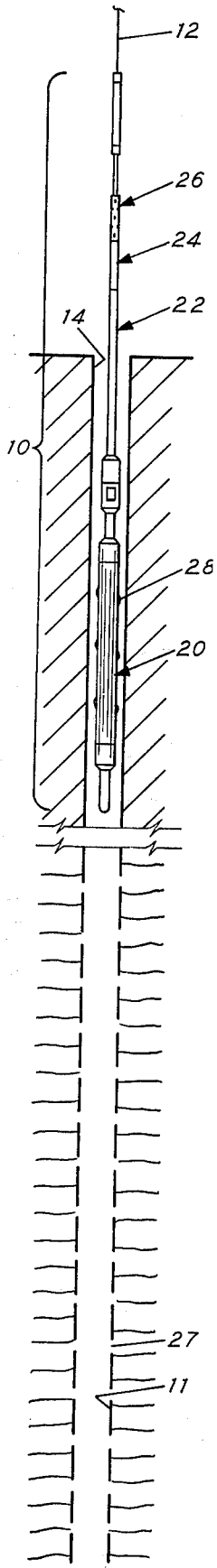
FIG. 5

251
246'
240'
248'
188'
254'
256'
250
253'
255'
258'
262'
266'
268'

GAS OPERATED HYDRAULICALLY ACTUATED WIRE LINE PACKER

CROSS REFERENCE TO RELATED APPLICATIONS

This application is related to the following coassigned applications: application Ser. No. 367,602 filed June 6, 1973, now U.S. Pat. No. 3,899,749; application Ser. No. 423,593 filed Dec. 10, 1973, application Ser. No. 430,326 filed Jan. 2, 1974; application Ser. No. 373,341 filed June 25, 1973, now U.S. Pat. No. 3,855,854; application Ser. No. 373,342 filed June 25, 1973, now U.S. Pat. No. 3,855,855; application Ser. No. 373,343 filed June 25, 1973, now U.S. Pat. No. 3,855,856; concurrently filed application Ser. No. 510,260, filed Sept. 30, 1974 for Hydraulically Actuated Wire Line Apparatus by Neal L. Mitchell, and Application Ser. No. 510,265, filed Sept. 30, 1974 for Wire Line Inflatable Packer Apparatus by S. O. Hutchison. The contens of all eight of the above applications are hereby incorporated herein by reference.

FIELD OF THE INVENTION

The present invention relates to wire line inflatable packers which are run into a well on a wire line and which carry self-contained inflating fluid and operate automatically to inflate and deflate in the well on a predeterminable time schedule. More particularly, the present invention relates to a self-contained wire line run inflatable packer useful to carrying an impression element on its outer surface for making an impression of a downwell surface, the inflatable packer being automatically sequentially inflated and deflated downwell by a valve controlled by fluid driven sequencing timer actuating means.

BACKGROUND OF THE INVENTION

In the operation of wells it is often desirable to know the downhole condition of a well surface such as a well liner or well casing. For example, it is important to know if the casing or the liner is cracked. Similarly, the extent of liner slot plugging and perforation size or absence is also useful information. This type of well information can be obtained by the use of impression packers. An impression packer is a device which is run down a well to a location from where information is desired and then an impression element is pressed against the well surface by suitable means usually an inflatable packer to take an impression of the well surface. The impression element is removed from the well surface usually by deflating the inflatable packer and then removed from the well for inspection.

The above cross referenced applications relate in part to suitable impression elements and to suitable inflatable packers for use in running an impression element in a well. The inflatable packers there described, however, and those heretofore used in the prior art have been run on a tubing string made of a number of tubing sections coupled together. The tubing string provides a conduit from the surface to the packer into which a fluid is injected down the well and into the packer to inflate it. The tubing string conduit is also used to deflate the packer. In the crudest form, this is done simply by releasing the pressure on the packer by venting the tubing string to atmosphere. In more sophisticated systems the packer may be deflated by a downhole device which can be triggered by dropping a sinker bar or a similar weight from the surface down the tubing string. A drawback to the use of a tubing string for running inflatable packers, however, is the time and trouble of making up the tubing string from a plurality of tubing sections which must be successively coupled together at the surface as the tubing string is formed and lowered into the well. A well pulling rig is also needed to run and pull the tubing string.

In order to dispense with the use of the tubing string it has been found desirable to develop an inflatable packer which can be run on wire line and which needs no operational connection such as a tubing string or an electrical line to the surface. However, as noted when the inflatable packer is used to carry an impression sleeve into the well to obtain impressions therefrom certain problems are encountered. Thus, the impression sleeve must be first lowered into the well to a depth where information is needed prior to inflating the packer to cause the impression sleeve to contact the well surface. Additionally, it is usually desirable to have the impression sleeve contact the well surface for a predeterminable time at a predeterminable pressure before deflating the packer and removing the packer carrying the impression sleeve from the well. In addition to these problems a wire line inflatable packer must be entirely self-contained which necessitates carrying with the packer a source of high pressure gas for inflation use. The present invention is directed to solving these problems and thus providing an efficient and reliable wire line inflatable packer which is useful in making impression packer runs in wells.

BRIEF DESCRIPTION OF THE INVENTION

The present invention is directed to a wire line inflatable packer which is self-contained and which includes a sequencing timer actuating means for sequentially inflating and deflating the inflatable sleeve of the packer on a predetermined time schedule. The timer actuating means is initially activated on the surface and the packer is run into a well with the inflatable sleeve in a deflated condition. After passage of a predeterminable time the sequencing timer actuating means acting on valve means within the packer operates to inflate the inflatable sleeve of the packer. The packer sleeve is maintained in such inflated condition for a predeterminable time and then the sequencing timer actuating means operates the valve means to deflate the inflatable sleeve of the packer and to thus put the packer in condition to be removed from the well. After the initial operation is initiated at the surface the downhole sequencing of the packer is done automatically by means carried with the wireline run inflatable packer. The sequential downhole operation of the inflatable packer is particularly useful when an impression sleeve is used in obtaining an impression record of the well at a given depth.

In a broad aspect the present invention is directed to an inflatable packer which has an elongated body which includes a tubing section. Means are provided for connecting a wireline to the upper end of the elongated body for running it into a well. An elongated inflatable resilient sleeve is positioned over at least a portion of the tubing section and the ends of the resilient sleeve are connected in fluid-tight relationship with the tubing section to form an annular chamber between the tubing section and the resilient sleeve. A port means provides a passageway for flowing fluid to and from the annular chamber. A gas source for storing high pressure gas is located in the elongated body of the packer and is used in inflating the resilient sleeve and as an operating gas for powering sequencing timer actuating means of the packer for controlling inflation and deflation of the packer. A pressure sink is fomred for use in deflating the resilient sleeve. Suitable conduits are connected between the gas source and the port means and between the port means and the pressure sink for use in inflating and deflating the sleeve. Valve means are connected to the conduits for selectively controlling flow of high pressure gas between the port means and the gas source through the conduits to inflate the resilient sleeve and between the port means and the pressure sink through the conduits to deflate the resilient sleeve. The sequencing timer actuating means is connected to the valve means for sequentially operating the valve means to first inflate the resilient sleeve after passage of a predeterminable time interval long enough to run the packer to the desired depth in a well and then to deflate the resilient sleeve after passage of a second predeterminable time interval to put the packer in condition for being pulled up the well. The timing sequence of the sequencing timer actuating means is determined by flow of a noncompressible thermally stable liquid through an orifice. The noncompressible liquid is driven through the orifice by an operating gas.

The present invention is particularly directed to the sequencing timer actuating means of the wire line inflatable packer which is utilized to operate valve means to inflate and deflate the inflatable sleeve of the packer. The timing sequence of the sequencing timer actuating means is determined by the flow of a noncompressible liquid through an orifice. The noncompressible liquid is driven through the orifice by means of an operating gas. In preferred form the valve means includes an elongated stem having means for sequentially opening and closing certain conduits to inflate and deflate the inflatable sleeve of the packer. The stem is connected to a drive piston located in a cylinder. The cylinder is divided into two portions by an orifice. The drive piston is located in one portion of the cylinder on the downstream end of the orifice and a free piston is located in the other portion of the cylinder on the upstream side of the orifice. The space in the cylinder between the pistons is filled with a noncompressible liquid. As the liquid is driven through the orifice by an operating gas acting on the free piston the drive piston moves the stem to sequentially open and close certain conduits to cause gas to flow to inflate and deflate the inflatable sleeve. Use of an operating gas to drive the free piston frees the operation of the packer from forces of gravity and thus the packer may be used in wells that deviate from vertical.

The source of high pressure gas is preferably contained within the tubing section which carries the inflatable sleeve. Suitable conduits are provided to arrange a flow path for the gas from this source to the annulus between the inflatable resilient sleeve and the outside of the tubing section. This flow path is controlled by the valve means. Pressure regulator devices may be included to adjust the pressure of the high pressure gas. Delta or differential pressure adjusting means for equalizing the effect of pressure in the well caused, for example, by liquid in the well are also provided. Suitable conduits connected through the valve means connect the annulus between the inflatable sleeve and the tubing member with a pressure sink for use in deflating the resilient sleeve. The pressure sink is usually a vent to the outside of the packer for exhausting fluids into the well. The source of high pressure gas may also provide an operating gas for operating the sequencing timer actuating means. Thus the high pressure gas after suitable pressure reduction is utilized to drive a noncompressible liquid through an orifice to control the timing sequence.

PRINCIPAL OBJECT OF THE INVENTION

The principal object of the present invention is to provide a self-contained wire line inflatable packer useful in obtaining impression records from wells which packer includes a gas operated hydraulically actuated sequencing timer means for controlling the inflation and deflation of the resilient sleeve of the inflatable packer. Additional objects and advantages of the invention will become apparent from a detailed reading of the specification and drawings which are incorporated herein and made a part of this specification.

BRIEF DESCRIPTION OF THE DRAWINGS

FIG. 1 through FIG. 5 inclusive are elevation views, partially in section, illustrating the preferred form of apparatus being run on wire line through a series of sequential operations preformed in a well to obtain an impression record therefrom.

DETAILED DESCRIPTION OF THE PREFERRED EMBODIMENT

Figure 6:
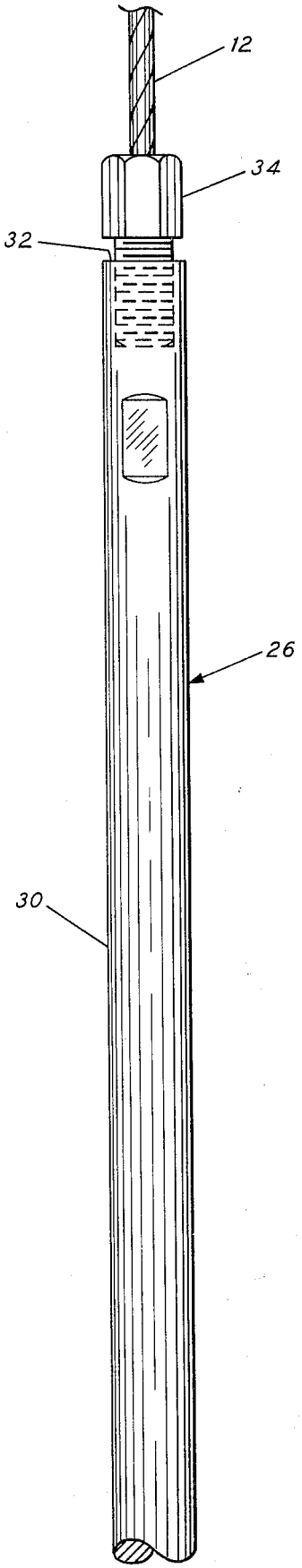
FIG. 6 through FIG. 17 inclusive are elevation views, partially in section, and illustrate the preferred embodiment of apparatus, sequentially from top to bottom, assembled in accordance with the present invention.
Figure 7:
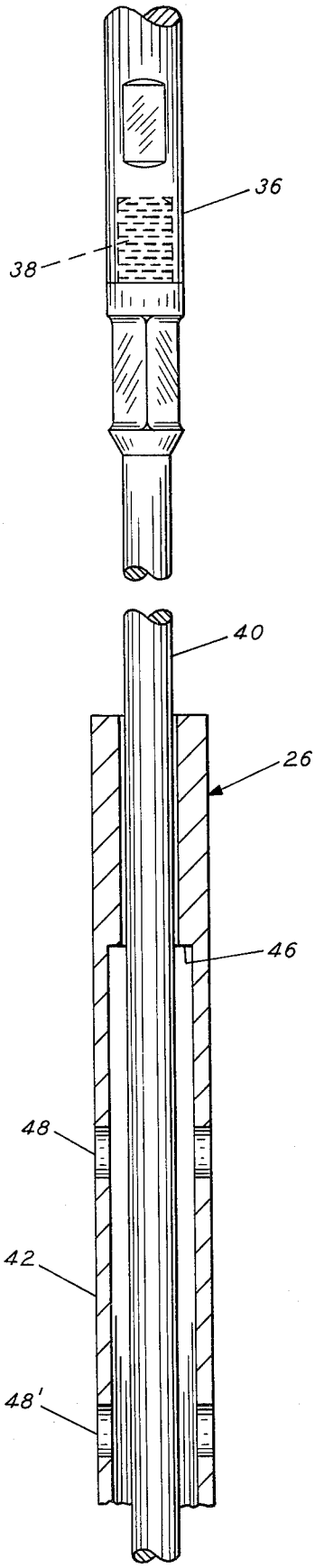
Figure 8:
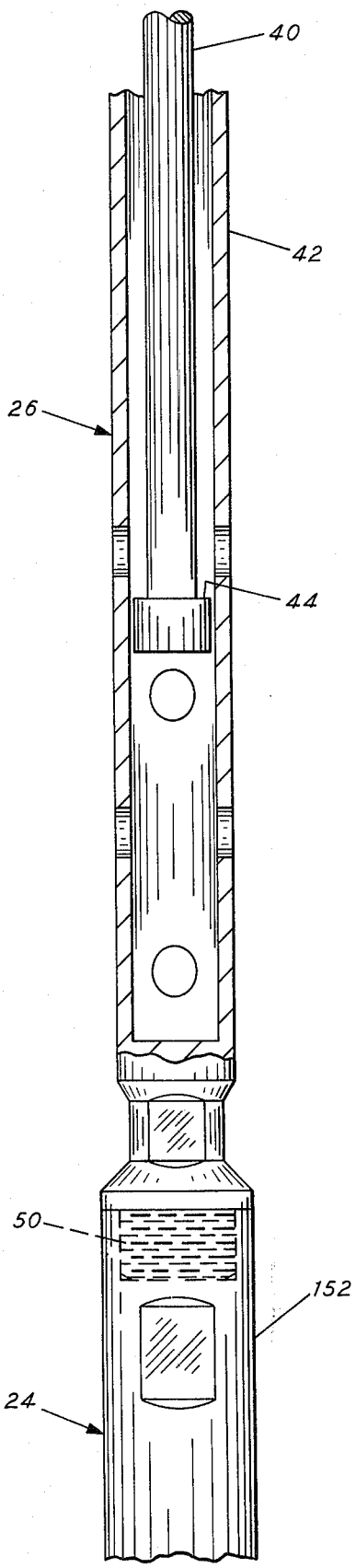

FIGS. 1 through 5 illustrate the preferred embodiment of apparatus of the present invention during an operational sequence in a well utilizing an outer impression sleeve to obtain information from the well. FIG. 1 shows the wire line inflatable packer, illustrated generally by the number 10, hung on wire line 12 in a well 14. A suitable hoist truck 16 is used to run the packer 10 in and out of the well. The inflatable packer 10 preferably includes a number of major subassemblies including an inflatable sleeve portion indicated generally as 20 and a control portion indicated generally as 22. The inflatable packer 10 may also include a pressure-temperature-subassembly indicated generally as 24 and a wire line jar subassembly indicated generally as 26.

The wire line inflatable packer 10 is lowered into the well on wire line to a position such as is shown in FIG. 2 from where it is desired to obtain an impression from the well wall. Prior to lowering the wire line inflatable packer 10 into the well a sequencing timer actuating means contained within the control portion 22 of the inflatable apparatus 10 is activated to begin an automatic sequence of inflation and deflation of the inflatable sleeve of the packer. Thus after elapse of a predetermined time which is of sufficient duration to permit positioning the wire line inflatable packer at the desired depth in the well the timer actuating means initiates operation of the inflatable sleeve of the packer and, as shown in FIG. 3, causes it to inflate and press the impression sleeve against the well liner 11. The impression sleeve on the outside of the inflatable sleeve of the packer is pressed into slots 27 or breaks in the well liner to form a lasting impression 28 on the impression sleeve. From the impressions on such a sleeve an accurate picture of the well liner condition can be formed. After a predetermined time has passed the sequencing timer actuation means operates the valve means of the packer to deflate the inflatable sleeve as indicated in FIG. 4. The inflatable wire line packer 10 is then returned to the surface by the wire line 12 as shown in FIG. 5. The impression sleeve is inspected to give an accurate picture of the condition of the well liner 11.

The wire line inflatable packer is self-contained. The inflating fluid is carried within the packer 10. This is usually high prssure gas. In many applications it is desirable to use a noncompressible liquid such as water in the annulus between the inflatable sleeve and the tubing section to act as a filler so that so much higher pressure gas is required to inflate the inflatable sleeve and to keep well pressure from crushing or wrinkling the inflatable sleeve. The control portion of the wire line inflatable packer includes sequencing timer actuating means for use in operating a valve arrangement to sequentially inflate and deflate the inflatable sleeve of the packer on a predetermined time schedule. The timer actuating means is initially activated on the surface and the packer is run into a well with the inflatable sleeve in a deflated condition. After a predeterminable time has elapsed the sequencing timer actuating means acts on valve means within the packer to cause inflation of the inflatable sleeve of the packer. The packer sleeve is maintained in such inflated condition for a predeterminable time and then the sequencing timer actuating means operates the valve means to deflate the inflatable sleeve of the packer and to thus put the packer in condition to be removed from the well. After the sequencing timer actuating means from the well. After the sequencing timer actuating means in started at the surface the downhole sequencing of the packer is done automatically by means carried with the wire line run inflatable packer. The sequential downhole operation of the inflatable packer is particularly useful when an impression sleeve is used in obtaining an impression record of the well at a given depth.

The preferred from of the inflatable wire line packer 10 is shown in detail in FIGS. 6 through 17. These figures illustrate the packer sequentially from the top down beginning where wire line 12 is connected into the upper portion of the packer 10. The wire line jar subassembly 26 includes one or more sinkers bars 30 to weight the apparatus for wire line jarring it loose if necessary. The upper portion 32 of the sinker bar 30 is taped with threads for receiving a pin end 34 of the wire line 12. The lower end 36 of the sinker bar 30 mates with the upper end 38 of a jar rod 40. The jar rod 40 is slideably received into a tubular sleeve member 42 and is retained therein by means of flange 44 contacting shoulder 46. A series of holes 48, 48′ permit fluid flow into and out of the interior of sleeve member 42. The lower end 50 of sleeve member 42 is threadably connected to the upper portion of a pressure-temperature-subassembly 24. The wire line jar subassembly thus often permits freeing the wire line packer if it becomes stuck in the well by reciprocating the wire line 12 to cause the jar rod 40 to hit against the sleeve member 42.

The pressure-temperature-subassembly 24 is used when it is desired to record pressure-temperature data during the operation. There are many conventional pressure-temperature subassemblies adapted for use in accordance with the invention. Therefore, a specific description of the pressure-temperature subassembly is not given here. One such conventional pressure-temperature subassembly useful in accordance with the present invention is known as product KPG AMERADA TYPE manufactured by the Kuster Company.

The control portion 22 and the packer sleeve portion 20 of the wire line inflatable packer 10 of the present invention provide a self-contained automatic inflatable packer for running on wire line and it is useful in obtaining impression information from a downhole location in a well. In one aspect inflatable packer 10 has an elongated body which includes a tubing section. Means are provided for connecting a wire line to the upper end of the elongated body for running the inflatable packer into a well. An elongated inflatable resilient sleeve is positioned over at least a portion of the tubing section and the ends of the resilient sleeve are connected in fluid-tight relationship with the tubing section to form an annular chamber between the tubing section and the resilient sleeve. A port means provides a passageway for flowing fluid to and from the annular chamber. A gas source for storing high pressure gas is located in the elongated body of the packer and is used in inflating the resilient sleeve. The gas is also used as an operating gas to power the sequencing timer actuating means of the packer for controlling inflation and deflation of the packer. A pressure sink is formed for use in deflating the resilient sleeve. The pressure sink may be the outside of the packer which in operation is the well itself. Suitable conduits are connected between the gas source and the port means and between the port means and the pressure sink for use in inflating and deflating the sleeve. Valve means are connected to the conduits for selectively controlling flow of high pressure gas between the port means and the gas source through the conduits to inflate the resilient sleeve and between the port means and the pressure sink through the conduits to deflate the resilient sleeve. The sequencing timer actuating means is connected to the valve means for sequentially operating the valve means to first inflate the resilient sleeve after passage of a predeterminable time interval long enough to run the packer to the desired depth in a well and then to deflate the resilient sleeve after passage of a second predeterminable time interval to put the packer in condition for being pulled up the well. The timing sequence of the sequencing timer actuating means is determined by flow of a noncompressible thermally stable liquid through an orifice. The most highly suitable liquid for this use is mercury because it is extremely thermally stable and has, therefore, operated satisfactorily over a broad temperature range. If temperature requirements are not so strict other less thermally stable liquids may be used in place of mercury. The noncompressible liquid is driven through the orifice by an operating gas.

The sequencing timer actuating means of the wire line inflatable packer is utilized to operate the valve means to inflate and deflate the inflatable sleeve of the packer. The timing sequence of the sequencing timer actuating means is determined by the flow of a noncompressible liquid through an orifice. The noncompressible liquid is driven through the orifice by means of an operating gas. In preferred form the valve means includes an elongated stem having means for sequentially opening and closing certain conduits to inflate and deflate the inflatable sleeve of the packer. The stem is connected to a drive piston located in a cylinder. The cylinder is divided into two portions by an orifice. The drive piston is located in one portion of the cylinder on the downstream end of the orifice and a free piston is located in the other portion of the cylinder on the upstream side of the orifice. The space in the cylinder between the pistons is filled with a noncompressible liquid such as mercury. As the liquid is driven through the orifice by the operating gas acting on the free piston the drive piston moves the stem to sequentially open and close certain conduits to cause gas to flow to inflate and deflate the inflatable sleeve. The time required for the mercury to move through the orifice, the configuration of the valve means and the amount of pressure exerted by the free piston can be varied to vary the time sequence of inflation and deflation of the packer sleeve. These variables can be adjusted to give a desired time sequence for a given operation.

The source of high pressure gas is preferably contained within the tubing section which carries the inflatable sleeve. Suitable conduits are provided to arrange a flow path for the gas from this source to the annulus between the inflatable resilient sleeve and the outside of the tubing section. This flow path is controlled by the valve means. Pressure regulator devices may be included to adjust the pressure of the high pressure gas for use as an inflating gas and as an operating gas. Delta pressure means for equalizing the effect of pressure in the well caused, for example, by liquid in the well are also provided. Suitable conduits connected through the valve means connect the annulus between the inflatable sleeve and the tubing member with a pressure sink for use in deflating the resilient sleeve. The pressure sink is usually a vent to the outside of the packer for exhausting fluids into the well. The source of high pressure gas may also provide an operating gas for operating the sequencing timer actuating means. Thus the high pressure gas after suitable pressure reduction is utilized to drive a noncompressible liquid through an orifice to control the timing sequence.

Figure 9:
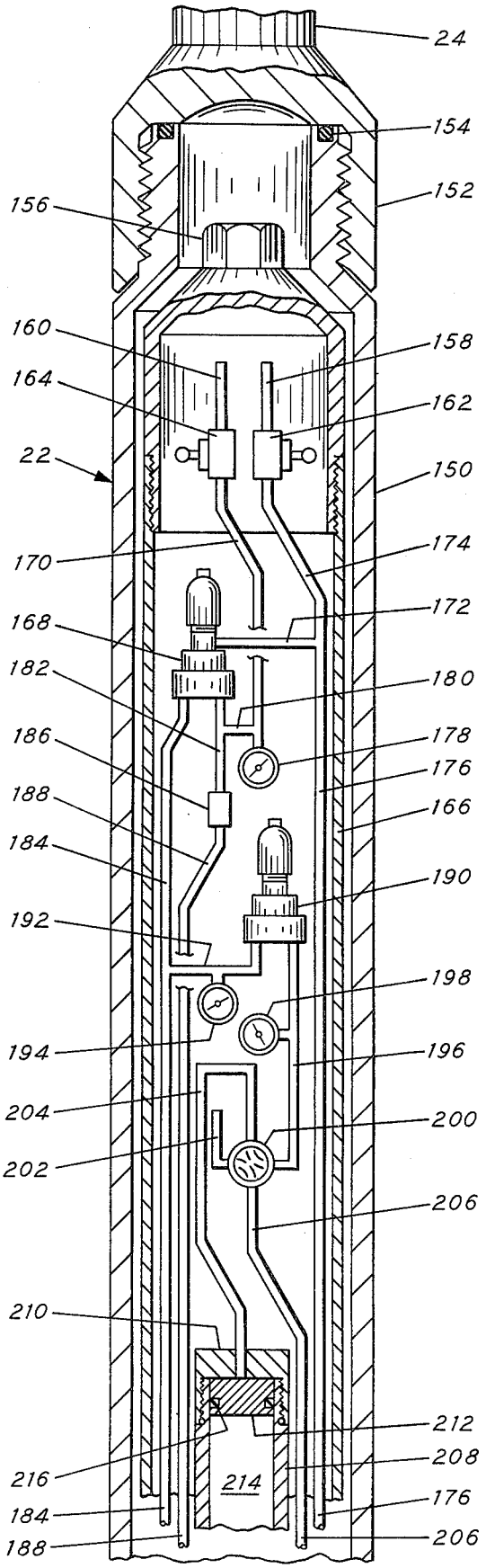

The control portion 22 and the inflatable sleeve portion 20 will now be described in detail with respect to FIGS. 9 through 17. In order to facilitate this description the inflatable sleeve portion 20 which is shown in the lower portion of FIG. 13 to FIG. 17 will be described before describing the control portion 22 which is shown in FIG. 9 to the upper portion of FIG. 13. The inflatable sleeve portion 20 includes a resilient sleeve positioned on an inner tubing section. The resilient sleeve is expanded by injecting fluid into the annulus between the tubing section and the interior of the resilient sleeve. The inside of the tubing section serves as a container for a pressurized gas useful to inflate the resilient sleeve.

An elongated inner tubing section is formed in the preferred embodiment by an upper tubular member 60 and a lower tubular member 62 connected together by a packer crossover sub 64. The crossover sub 64 has a conduit 66 connecting the interiors 75, 75' of the tubular members 60, 62. Fluid-tight joints are provided between the tubular members 60, 62 and the crossover sub 64 by means of O-rings 68, 70. A disconnecting sub 72 seals off the upper portion (except for passageways 110 and 96 as later described) of the upper tubular member 60 utilizing O-ring 74. A bottom plug 76 seals off the lower portion (except for passageway 104 as later described) of the lower tubular member 62 utilizing O-ring 78. Thus a fluidtight chamber is formed inside the tubing section of the packer and this chamber is used to contain high pressure fluid such as nitrogen gas which is used as the energy fluid to inflate the resilient sleeve and as the operating fluid to drive the sequencing timer actuating means.

It has been found that the volume of gas needed to inflate the resilient sleeve can be greatly reduced by filling most of the volume to be filled with a noncompressible liquid such as water. Therefore, the preferred embodiment is arranged to facilitate loading the annular space 80 between the outside of the tubing section formed by tubular members 60, 62 and the inside of the inflatable sleeve 82 with a noncompressible liquid such as water. Thus crossover sub 64 is provided with an upper passageway 84 communicating with the annular space 80 and a lower passageway 86 also communicating with the annular space 80. A conduit 88 having a connector 90 is connected into passageway 84 and extends through O-ring 94 into passageway 96 in the disconnecting sub 72. An extension conduit 98 having a valve 100 extends out of passageway 96 to provide communication from outside of the packer portion to the annular chamber 80. A conduit 102 having a connector 104 is connected into passageway 86 of crossover sub 64. Tubing section 102 extends into passageway 103 through plug sub 76 and is sealed therein by an O-ring 106. A control valve 108 located in a bull plug 111 for protection is connected to passageway 103 to control flow therethrough. Thus the annular space 80 may be loaded with water when the packer is horizontal by injecting water into one side of the chamber while bleeding air off from the other. After the annular space 80 and the conduits are so filled the valves 100 and 108 are closed to retain the water until the wire line apparatus is ready to run.

An outlet passageway 110 is formed in the disconnecting sub 72 to provide an outlet for high pressure fluid contained in the fluid-tight chamber 75, 66, 75' formed inside the tubing section of the inflatable sleeve portion of the packer. A fluid-tight conduit 112 having a control valve 114 is connected in passageway 110. Thus a source of high pressure fluid is provided within the inflatable sleeve portion of the packer to supply energy for the wire line packer.

The inflatable resilient sleeve 82 is connected at its upper and lower ends in fluid-tight relationship to the tubing section which is formed by the upper tubular member 60 and the lower tubular member 62. The upper and lower clamping means are usually similar in construction. In this description as well as in other portions of this specification the same numbers with prime notations are used to indicate similar parts used to indicate the different parts of the apparatus. The clamping means includes an inner sleeve 116, 116' which fits in sliding relationship over the tubular members 60, 62. The outside surface of the inner sleeve 116, 116' has a number of annularly extending serrations 118, 118°. An O-ring 120, 120' is located between the inside of the inner sleeve 116, 116' and the outside of the tubular member 60, 62 to provide a fluidtight seal between the tubular member 60, 62 and the inner sleeve 116, 116'. Retaining rings 122, 122' and 124, 124' are connected in grooves on the exterior of the tubular members 60, 62 above and below the inner sleeve 116, 116' to limit the movement of the inner sleeve and thus the clamping means on the tubular members 60, 62. The retaining rings 122, 122' and 124, 124' can be removed and repositioned in other grooves conveniently located on the exterior of the tubular members 60, 62. Thus if the flexible resilient sleeve 82 must be shortened during field repair the retaining rings are removed and the clamping means are moved to a new position on the tubular members and reconnected. A force fit outer sleeve 126, 126' cooperates with the inner sleeve 116, 116' to hold the end of the resilient sleeve 82. The resilient sleeve 82 is positioned against a flange 128, 128' formed on the upper portion of the exterior of the inner sleeve 116, 116'. A retaining ring 130, 130' is fitted into a groove on the outside of the inner sleeve to prevent movement of the outer sleeve 126, 126' after connection has been made. The interior of outer sleeve 126, 126' is provided with annular protruberances 132, 132' which cooperate with the serrated portion 118, 118' of the inner sleeve 116, 116' to grip the end of the resilient sleeve 82 to hold the sleeve 82 in fluid-tight relationship with the mandril 60, 62. An impression sleeve 81 is connected to the outside of the inflatable resilient sleeve 82 for use in making an impression of a well conduit as described above.

The inflatable sleeve portion 20 of the packer thus includes a chamber 75, 75' for storage of gas useful to inflate the inflatable element 82. In preferred form this chamber is loaded with nitrogen at high pressure, usually in excess of 2000 psi. Since operating pressure of the inflatable sleeve is usually much lower than 2000 psi the high pressure gas is pressure regulated to a lower pressure prior to being utilized to inflate the inflatable sleeve. Pressure reduction of the gas is also desirable before using the gas as an operating fluid for the sequencing timer actuating means in the control portion. Valves 114 and 110 control flow, respectively, out of the high pressure chambers 75, 75' and into the annulus 80 formed by inflatable element 82 and the outside of the tubing section formed by the upper tubular member 60 and the lower tubular member 62. The high pressure gas from the fluid-tight chamber 75, 75' may be flowed through conduit 112, valve 114, conduit 320 and passageway 292 into the control portion which is indicated generally as 22 of the inflatable packer 10. A suitable O-ring 318 seals conduit 320 into passageway 292 in control sub 290. An O-ring 316 also seals conduit 322 into passageway 296 of the control sub 290. Control sub 290 is connected to the disconnecting sub 72 by a shearable means so that if the inflatable sleeve portion 20 becomes stuck in a well the upper portion of the wire line packer may be pulled free and removed from the hole. After shearing pins 310 and 312 sub 290 moves up a sufficient distance so that passageways 320 and 322 clear O-rings 318 and 316 respectively. The high pressure gas in chamber 75, 66 and 75' and the gas and water in the annulus 80 can then escape through port 311. A fishing sleeve 308 is threadably connected to disconnecting sub 72 and an inner annular sleeve 314 is threadably connected to control sub 290. Shear pins 310, 312 connect the sleeves 308, 314 together for normal operation.

Figure 12:
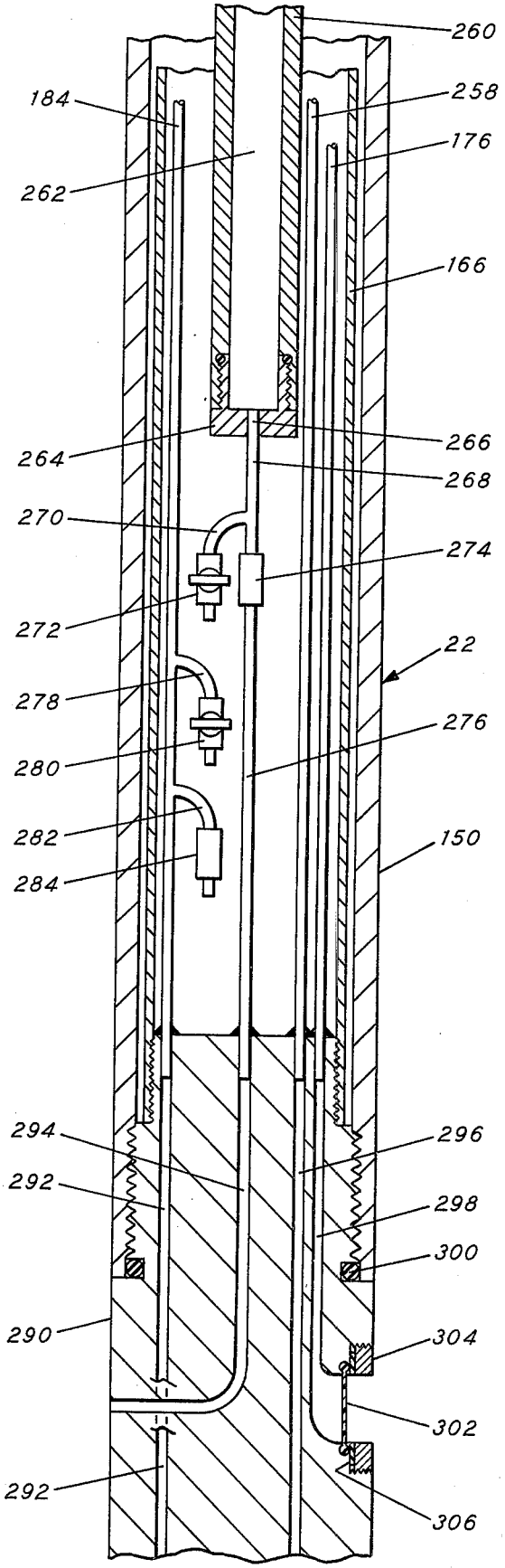
Figure 13:
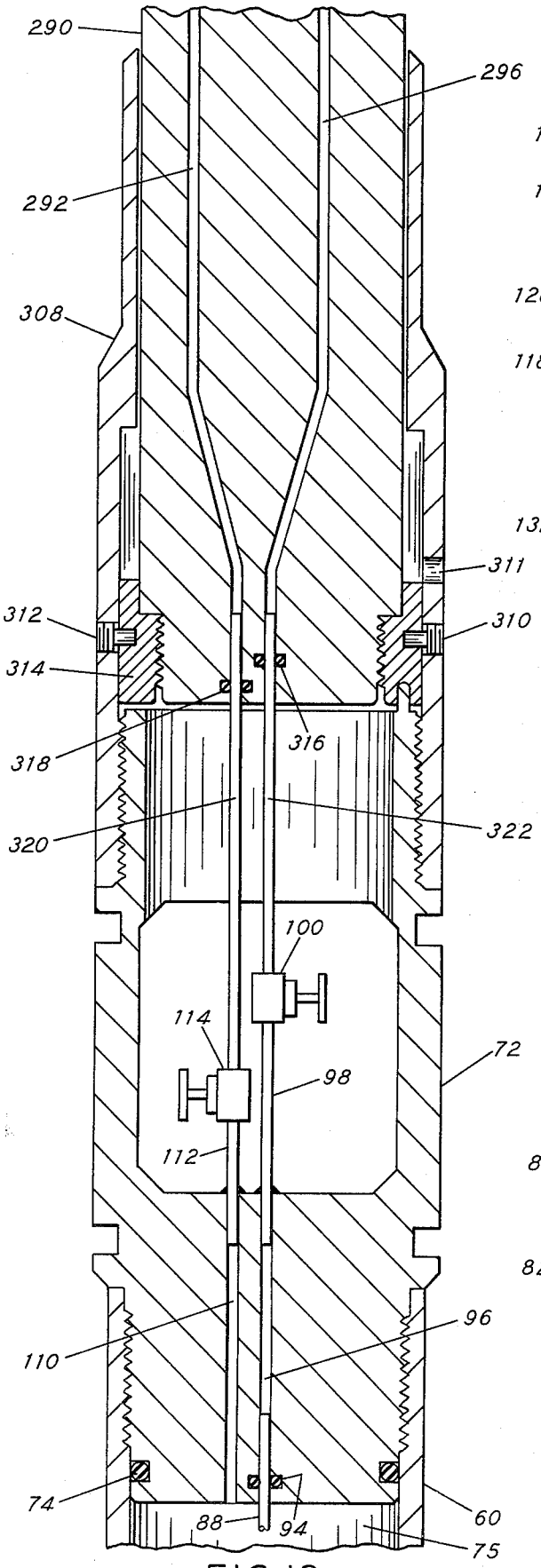
Figure 14:
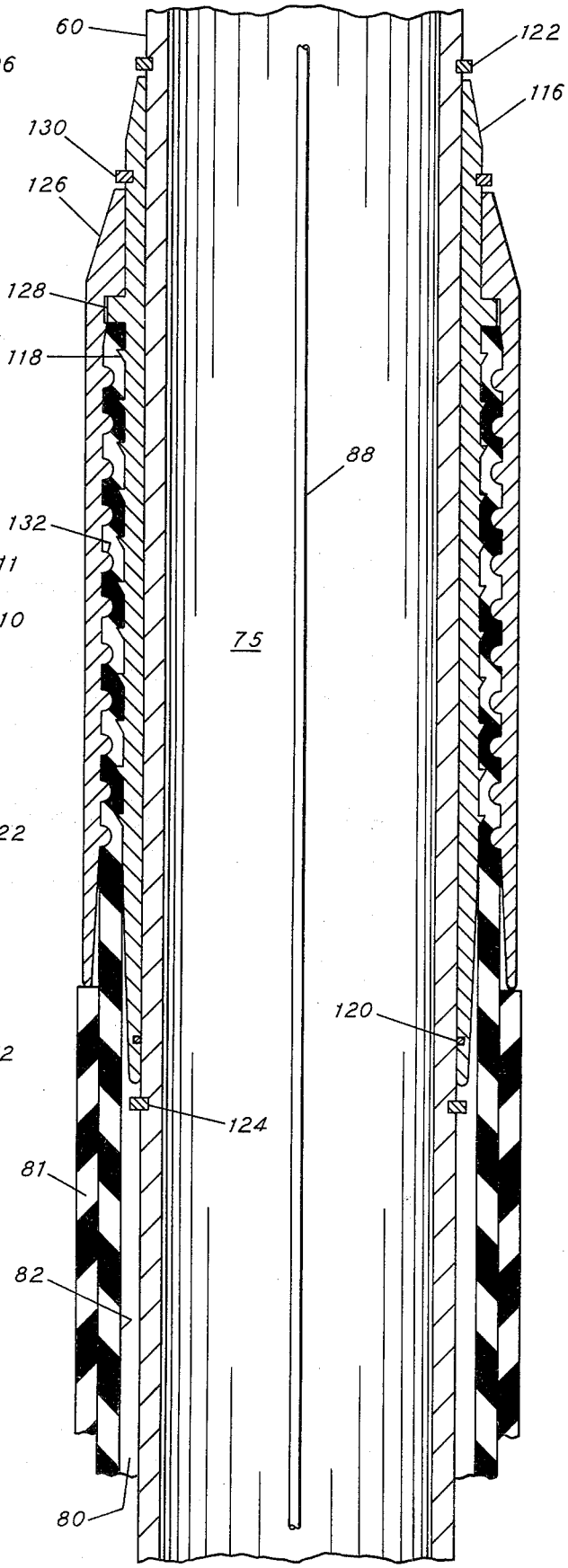
Figure 15:
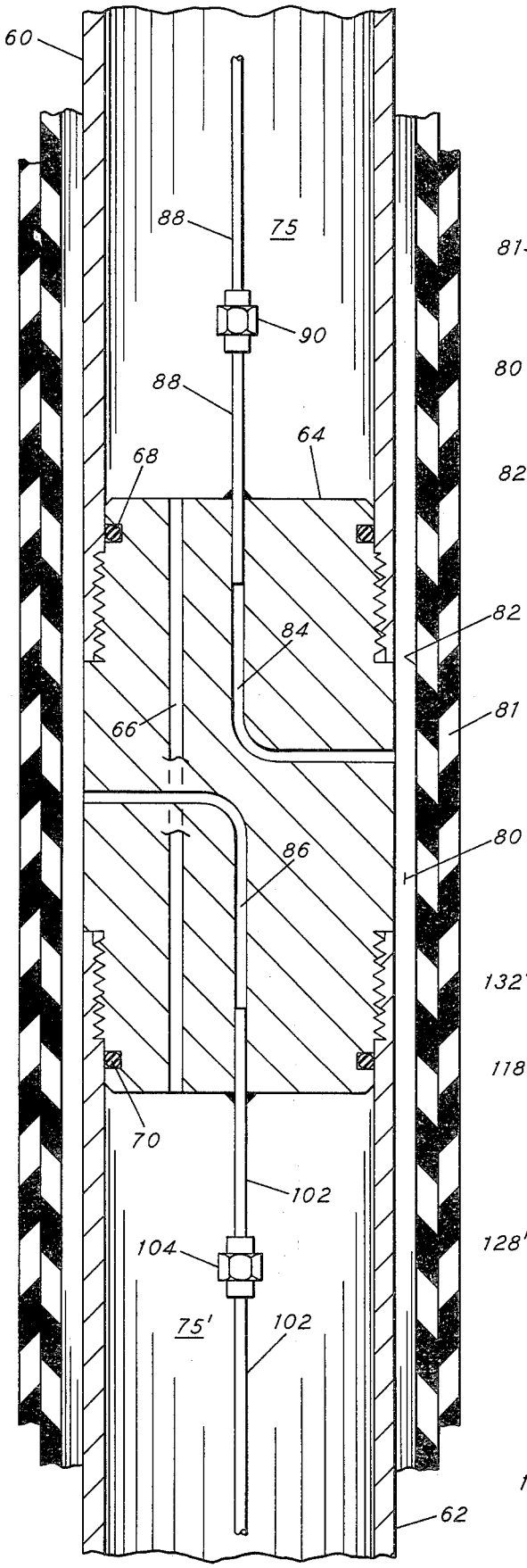
Figure 16:
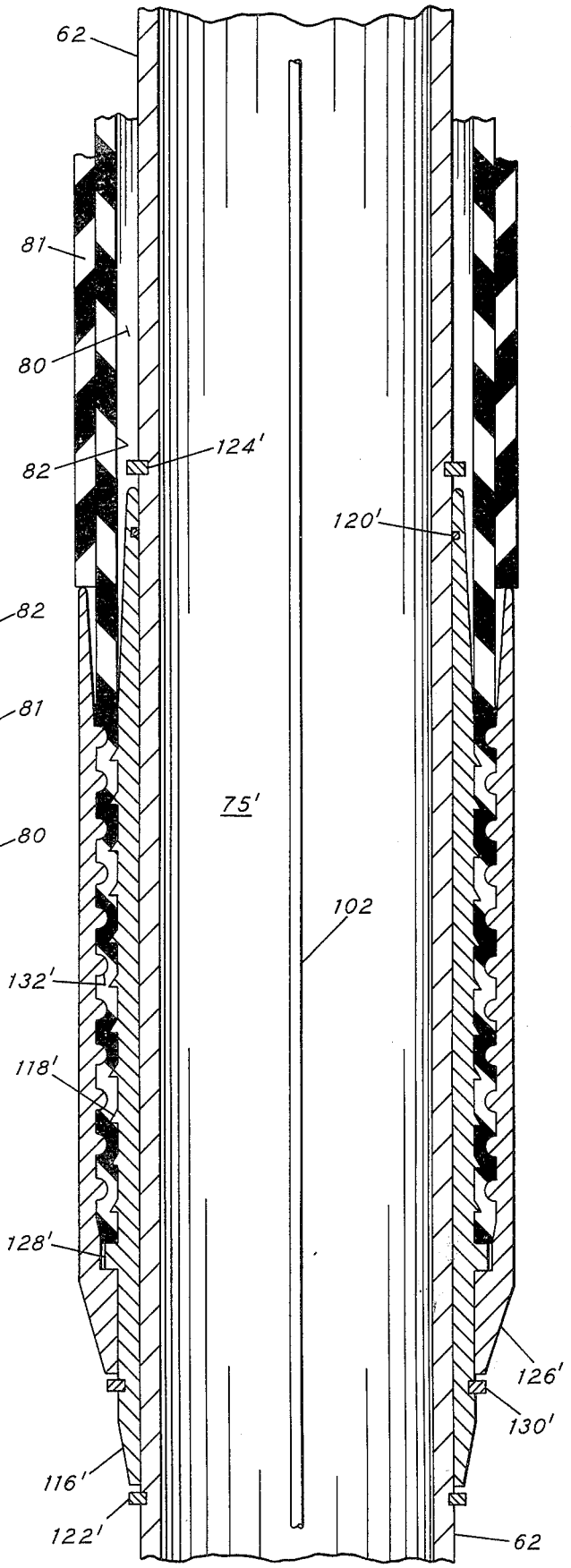
Figure 17:
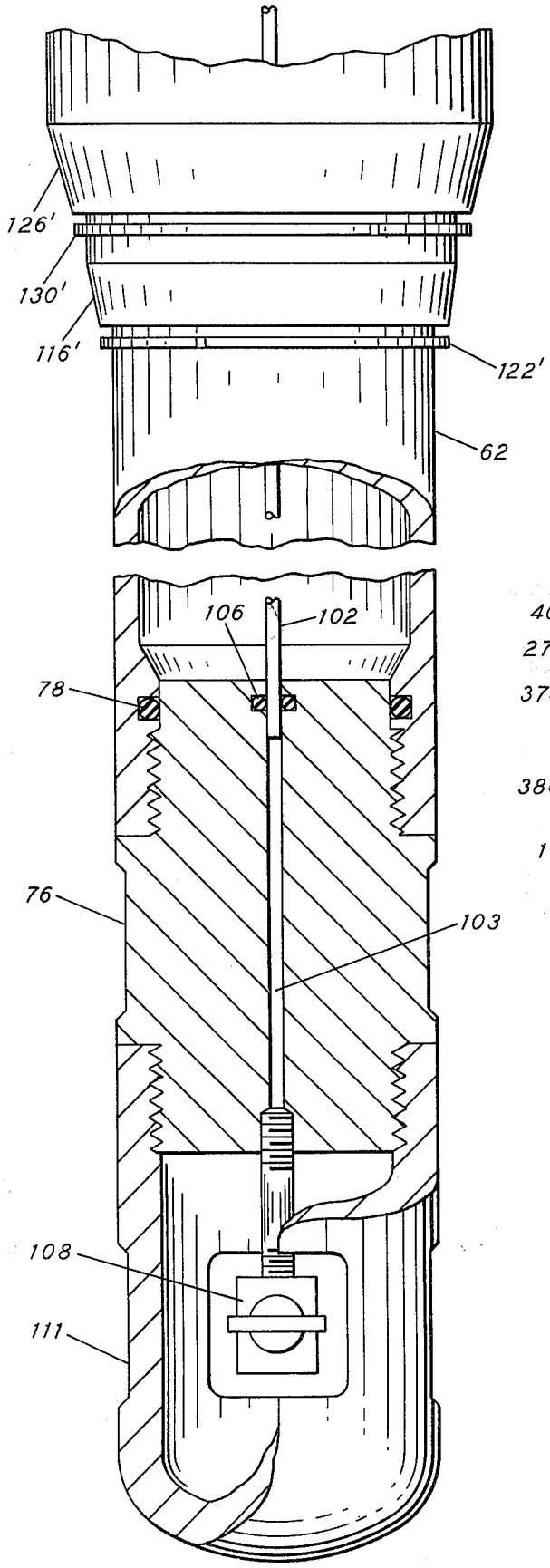

The control portion 22 of the inflatable wire line packer 10 will now be described with reference to FIGS. 12 through 9. The control portion includes the sequencing timer actuating means and the valve means which control flow through conduits to inflate and deflate the packer which is assembled in accordance with the present invention. The elongated body above the tubing section is now continued by outer tubular member 150. The upper end of the outer tubular member 150 is connected to the lower end 152 of the wire line jar subassembly 24 by threaded connections containing a suitable O-ring 154. The lower end of the outer tubular member 150 is threadably connected to the control sub 290 and sealed by an O-ring 300. An inner shell 166 supports the valve means and sequencing timer actuating means of the wire line inflatable packer. Cap member 156 allows access to the interior of the shell member 166.

Conduit 184 is connected in fluid-tight relationship into passageway 292 and provides a passageway for high pressure gas to pressure regulator 168. A branch conduit 282 containing check valve 284 is provided for loading high pressure gas into the chamber 75, 75' of the tubing section. A second branch conduit 278 containing control valve 280 is provided for drainage gas from the system if desired. The high pressure of the gas is reduced to a suitable working pressure for use in inflating the inflatable sleeve of the packer in a particular well in pressure regulator 168. Relatively low pressure inflating gas leaves pressure regulator 168 via conduit 182. This inflating gas will ultimately be used to inflate the inflatable sleeve of the wire line packer. The pressure of the inflating gas is determined by means of an adjustable spring pressure regulator 168 and the delta pressure means for equalizing the effect of well pressure which is added to the spring from conduit 172. The operation of the pressure regulator 168 is described in detail below with respect to FIG. 18. The delta pressure means for equalizing the effect of well pressure includes conduit 172 which connects with conduit 176 and extends to a diaphragm 302 contained in control sub 290 by means of O-ring 306 and annular nut 304. The interior of the conduits 172, 176 is loaded with a noncompressible liquid such as mercury through conduits 158 and 174. The mercury is retained in these conduits by means of a suitable valve 162. When the apparatus is run in a well the pressure outside the well is transmitted via diaphragm 302 to the mercury and thence to the pressure regulator to equalize the effect of the well pressure on the inflatable element. In this manner the pressure used to inflate the inflatable element is independent of the fluid head or pressure in the well.

Inflating gas comes out of the pressure regulator 168 through conduit 182. A branch conduit 180 leads to pressure gauge 178. An extension conduit 170, 160 having a valve 164 is provided to conduit gas to a pressure assembly if this device is used in a particular operation. Inflating gas is conducted by means of conduit 182 through check valve 186 and conduit 188 to the valve means of the invention. Inflating gas enters the interior of a tubular member 248 through port 250. An elongated movable piston member 240 having a portion of reduced diameter 246 is contained inside of tubular member 248, tubular crossover member 252, tubular member 260 and tubular member 236. There is a small clearance of approximately three one thousands of an inch between the exterior of the piston member 240 and the interior of the above recited tubular members for gas flow. This clearance is too small to be shown in the drawings but is indicated as 242. O-rings 237, 253, and 255 positioned at the connections between tubular members 236, 248 252 and 260 prevent flow through annulus 242 between the full size portion 240 of the piston member and the inside of the contacting O-ring. Thus with piston member 240 shown in the position illustrated in FIG. 11 the gas entering tubular member 248 through port 250 will be retained in this tubular member by the O-rings 237 and 253 above and below it. As the reduced diameter portion 246 of tubular member 240 moves downwardly and bridges ports 250 and 254 and 256 gas will flow across the bridged O-ring 253 through ports 254, 256 into conduit 258. Conduit 258 is connected into pasageway 296 which in turn is connected to conduits 322 and 98. Conduit 98 leads to passageway 96 and conduit 88 which is connected to passageway 84 and thus to annular space 80 to inflate inflatable element 82.

When the reduced diameter portion 246 bridges port 256 and O-ring 255 and the enlarged space 262 within tubular member 260 and the upper enlarged portion of piston 240 engages to O-ring 253 between tubular member 248 and the tubular crossover member 253 the inflatable sleeve is deflated. Thus gas and/or water from the annular chamber 80 passes to a pressure sink, i.e., the well, through the reduced diameter portion 246 of the piston across the O-ring 255 between crossover member 252 and tubular member 260 into chamber 262 and out of the wire line packer to the pressure sink via port 266 in plug member 264 and conduit 268, check valve 274, tubing 276 and passageway 294. A bleed conduit 270 is provided with a manual control valve 272 for manual use if necessary. The clearance between the interior of tubular member 260 and the lower portion of piston member 240 is much greater than the clearance in the inflation portion of the piston-tubular member annulus since water and gas will be forced out these conduits by the differential fluid head in the well coupled with the force of the resilient sleeve as it deflates.

Thus, control valve piston 240 having a reduced diameter portion 246 is moved by the sequencing timer actuating means across various ports in tubular members 236 et al. to inflate and deflate the inflatable sleeve of this embodiment of the wire line packer. Piston 240 is connected to an elongated stem 232, which extends into a cylinder defined by tubular members 230, 208 crossover subs 234, 220 and cap 210. Thus, the lower portion of tubular member 230 is connected to tubular member 236 by means of a crossover sub 234. The crossover sub 234 is provided with a central opening and the stem 232 is sealed by means of an O-ring 239 located therein. The upper end of tubular member 230 is connected to tubular member 208 by means of a crossover sub 220. The upper portion of tubular member 208 is provided with a cap member 210 having a central opening located therein. This upper tubular member forms a chamber 214. Chamber 214 contains a free piston 212 which is placed in fluid tight relationship therein by means of O-ring 216. An orifice 218 in crossover member 220 divides the cylinder and provides communication between the upper chamber 214 in tubular member 208 and the lower chamber 217 in tubular member 230. A check valve 224, which permits flow from chamber 217 to chamber 214 but not in the reverse direction, is also located in crossover sub 220.

In accordance with the preferred form of the invention, chamber 214 below free piston 212 and chamber 217 above piston 226, which is connected to the elongated stem 232, is loaded with mercury or other suitable thermally stable noncompressible liquid. Mercury is injected into the chambers 214, 215 through port 222 in crossover sub 220. Free piston 212 and drive piston 226 having the elongated stem 232 attached thereto are shown in the initial position in their respective chambers within the cylinder. It is evident that when a noncompressible fluid is located in chambers 214, 217, when free piston 212 is driven down chamber 214, drive piston 226 having O-rings 228 will be driven down chamber 217, and in turn the elongated stem 232 will move piston member 240 down the tubular members located below to operate the valve means to inflate and deflate the resilient sleeve of the packer. The speed at which the pistons 212 and 226 will move depends on the size of orifice 218 and the amount of pressure placed on the upper surface of free piston 212.

Means are provided to supply an operating gas for applying pressure on the upper surface of free piston 212 to move the mercury through the orifice and to drive the drive piston and the elongated stem to operate the valve means of the present invention through an operating sequence. Means are also provided for applying pressure to the bottom surface of the drive piston 226 to recock both the free and the drive pistons to place them in position to begin an operational sequence. This is the position illustrated in FIGS. 10 and 11. Operating gas pressure is supplied to the upper surface of the free piston 212 through a port in cap member 210 via conduit 204. Conduit 204 is connected into a four-way valve 200 which, when properly adjusted, will direct gas from pressure regulator 190 through conduit 196 and into conduit 204. Operating gas is supplied from the high pressure gas line 184 through a branch line 192 into the upstream end of the pressure regulator 190. Pressure gauges 194 and 198, respectively, indicate the pressure of the incoming gas and the outgoing gas. Pressure regulator 190 is adjustable so that the outgoing operating gas pressure may be adjusted to vary the force on the upper side of free piston 212. In this manner the time that is required to move drive piston 240 through its operational sequence may be varied thus varying the inflation and deflation time cycle. Once the pistons have moved to their limit in their respective chambers 214, 215 and it is desired to recock them for another operation, the four-way valve 200 is rotated to a position which directs gas from conduit 196 to conduit 206. This gas enters chamber 215 through port 238 and engages against the underside of piston 226. The piston is driven up chamber 215 and mercury is driven through check valve 224 to move the free piston in a like manner up chamber 217 to recock the pistons in a starting position.

Thus, when it is desired to begin an operational sequence of the packer, the pressure regulator 190 is adjusted to give a predetermined pressure on the downstream pressure gauge. When it is desired to initiate sequence, the wire line packer of the present invention is positioned at the upper portion of a well and valve 114 is initially opened. Four-way valve 200 is opened to cause the free piston 212 to begin moving down chamber 214. This movement, of course, is translated by means of mercury through the orifice 218 and the drive piston 226 and the stem 232 to the valve piston 240. As described above, the reduced diameter portion 246 of piston 240 bridges various ports to inflate and deflate the inflatable sleeve. When the four-way valve 200 is opened to flow operating gas through conduit 204 through one portion of the four-way valve a second flow path is also opened through the four-way valve to vent chamber 215 through port 238, conduit 206, four-way valve 200 and conduit 202 to the low pressure interior of shell member 166. This prevents gas from being compressed in chamber 215 as piston 226 moves down the chamber during operation.

Figure 10:
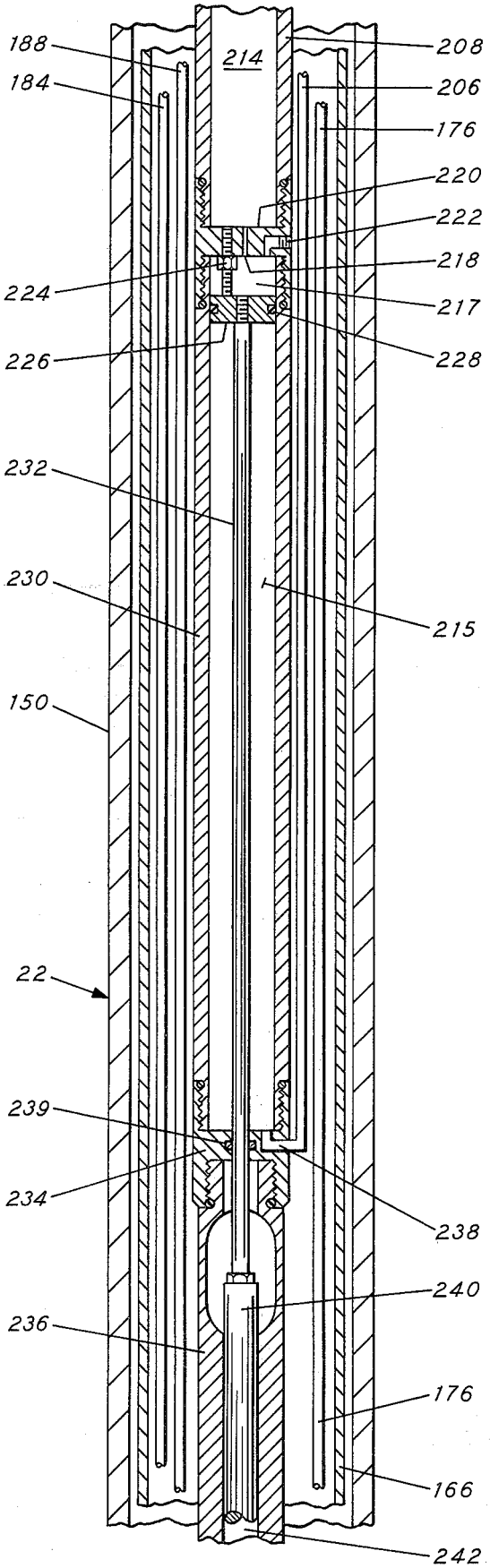
Figure 11:
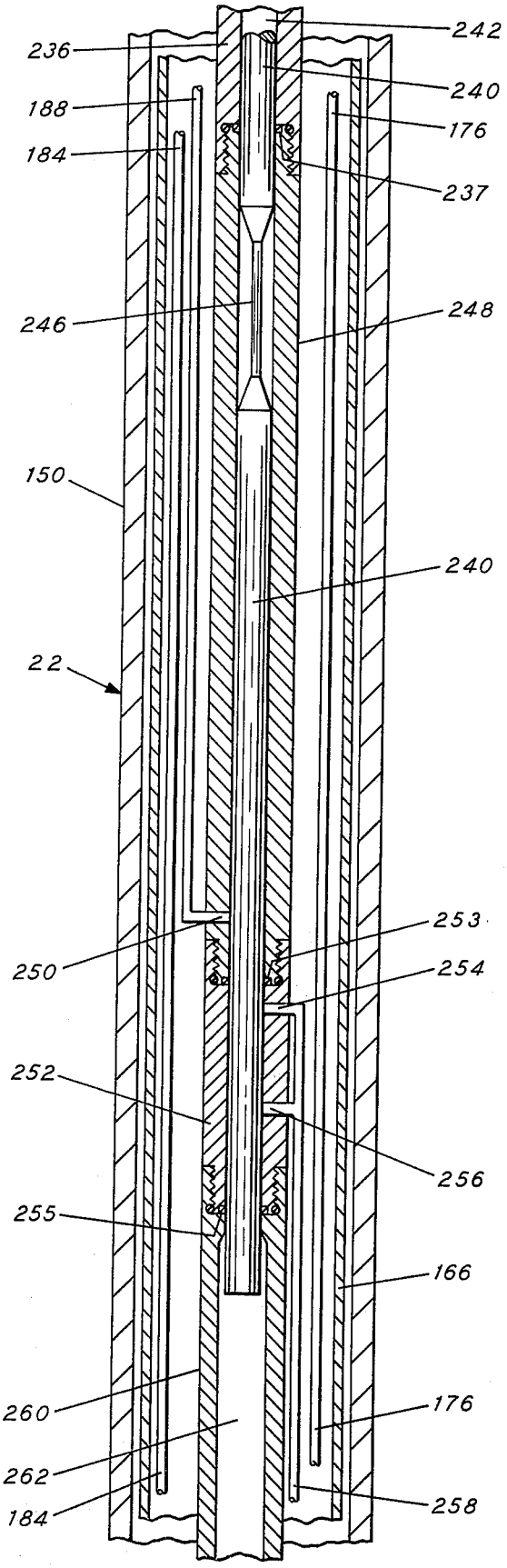
Figures 19, 20, 21, 22:
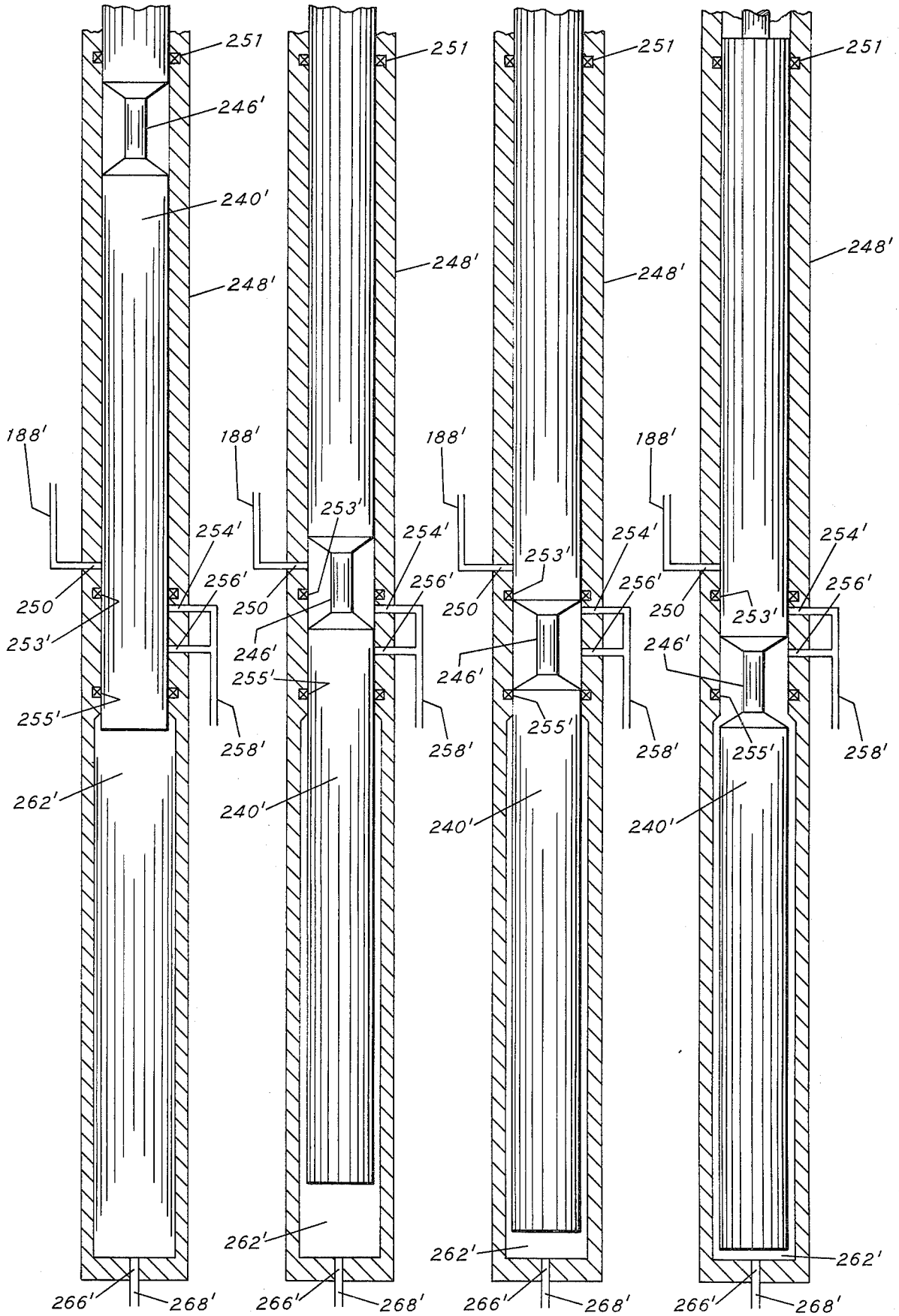
FIG. 19 through FIG. 22 inclusive are schematic views illustrating the operation of the preferred form of valve means assembled in accordance with the invention.

The operation of the valve means of the wire line inflatable packer of the present invention is illustrated schematically in FIGS. 19 through 22. The members used are primed and correspond to the numbers used in the above detailed discussion. In FIG. 19, the reduced diameter portion 246' of the piston 240' is located in conduit 248' in an initial position such as shown in FIGS. 9 and 10. Conduit 188' provides an inflating gas under pressure through port 250 into the interior of conduit 248'. As noted above, there is a clearance between piston 240 and the interior of conduit 248' such that gas will flow in the thin annular chamber therebetween up to the upper O-ring 251' and the lower O-ring 253'. The gas cannot bridge the space between the O-rings and the piston 240'. As discussed above, ports 254' and 256' provide an outlet from the interior of conduit 248' and by means of conduit 258' provide gas for inflating the inflatable sleeve. When piston 240' has moved to the position illustrated in FIG. 20, gas from conduit 188' passes across O-ring 253' and through port 254', thence through conduit 258' to inflate the inflatable sleeve. FIG. 21 illustrates the piston member 240' in a position where no gas is flowing either in or out of the inflatable sleeve. Thus it can be easily seen that the timing sequence is dependent on the pressure applied to free piston 212 the length of the reduced piston section 246' and the size of the orifice 218. In FIG. 22, the piston member 240' has moved to a position where flow is permitted from the inflatable sleeve through conduit 258' and port 256' past O-ring 255', past the lower portion of piston 240', and out of the lower chamber 262' through port 266' and conduit 268'. The gas and/or water from the inflatable sleeve annulus is driven in a backwards path through this course to a pressure sink to deflate the inflatable sleeve.

Figure 18:
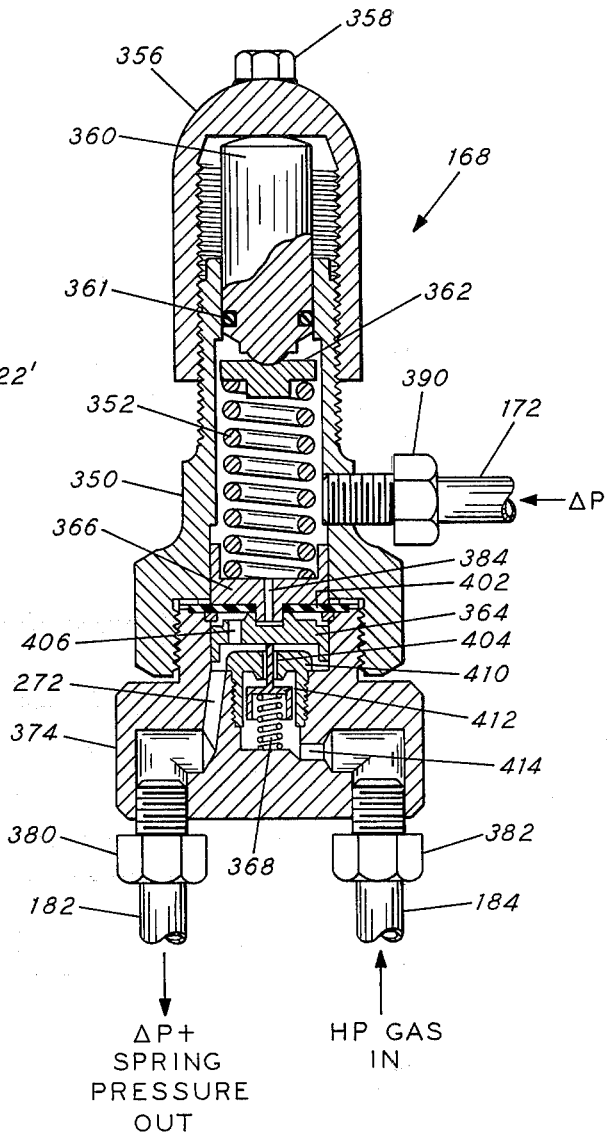
FIG. 18 is a sectional veiw of a pressure reducing device assembled in accordance with the invention.

FIG. 18 is a sectional view of pressure regulator 168 which provides inflating gas for the packer and which includes the well pressure adjustment. A main body portion 374 is provided with a high pressure gas inlet conduit 184 and an inflating gas outlet conduit 182. Nut heads 380 and 382 are used to make up the conduits in operating position. Internal passageways 414, 404, 412, 406 and 272 provide a path for gas flow from conduit 184 to conduit 182. An upper body member 350 is threadedly connected to the lower body member 374. Upper body member 350 has an inner chamber into which the fluid from conduit 172 is contained. As noted this is usually mercury. Nut head 390 is used in conduit 172 into the upper body member. A diaphragm 402 is connected between upper diaphragm plate 366 and lower diaphragm plate 364. A passageway 384 in plate 366 provides a communication between the plates. The upper plate 366 abuts against a spring 352 which is backed up by insert 362 and piston member 360. A cap 356 is threadedly engaged on upper body member 350 which when screwed down by means of nut 358, increases the pressure on the spring 352. An O-ring 361 prevents loss of pressure in the chamber.

The combination of spring pressure in spring 352 and fluid pressure from conduit 172 normally depresses upper diaphragm plate 366 against diaphragm 402 which transmits this force to lower diaphragm plate 364. Lower diaphragm plate 364 forces seat assembly 412 open which allows high pressure gas from conduits 184 to flow through passageways 414, nozzle 410 and then through passageway 272 and into conduit 182. When the desired pressure is reached in conduit 182, the pressure acting in passageway 272 working on lower diaphragm plate 364 and diaphragm 402 allows seat assembly 412 to seal off nozzle 410. Spring pressure in spring 368 causes seat assembly 412 to close and the high pressure gas in passageway 414 assists in effecting a seal. Thus, the flow of high pressure gas through nozzle 404 is stopped.

From the above it is clear that regulator 168 is dome loaded by the well pressure acting through diaphragm 302 and transmitted through a noncompressible liquid in conduit 172 and on to upper diaphragm plate 366 and diaphragm 402. This dome loading permits regulator 168 to increase the pressure in conduit 184 so that the well bore pressure can be added to the spring pressure to get a predetermined higher pressure in chamber 80 compared to the well bore pressure outside inflatable element 82. When control valve 246 gets in the inflating position so that the higher pressured gas in conduit 184 can flow through conduits 188, 254, 258, 296, 98, 88, 84 and into chamber 80 to inflate inflatable element 82 to the desired differential pressure so that impressionable material can be extruded into performation 27 to form impressions 28.

Although certain specific embodiments of the invention have been described herein in detail the invention is not to be limited to only such embodiments but rather only by the appended claims:

We claim:

1. A wire line inflatable packer comprising an elongated body including a tubing section; means for connecting a wire line to the upper end of said elongated body; an elongated resilient sleeve positioned over at least a portion of said tubing section; means connecting the ends of said resilient sleeve in fluid-tight relationship with said tubing section to form an annular chamber between said tubing section and said resilient sleeve; port means providing a passageway for flowing fluid to said annular chamber; gas chamber means for storing high pressure gas in said elongated body for use in inflating said resilient sleeve; pressure sink means forming a pressure sink for use in deflating said resilient sleeve; conduit means connected between said gas chamber means and said port means and between said port means and said pressure sink means for use in inflating and deflating said sleeve; valve means connected to said conduit means for selectively controlling flow of high pressure gas between said port means and said gas chamber means through said conduit means to inflate said resilient sleeve and between said port means and said pressure sink means through said conduit means to deflate said resilient sleeve; and sequencing timer actuating means connected to said valve means for sequentially operating said valve means after passage of a predeterminable time interval to first inflate said resilient sleeve and then after passage of a second predeterminable time interval to deflate said resilient sleeve, said sequencing timer actuating means comprising means defining an orifice, a supply of noncompressible liquid for flow through said orifice, operating gas means for driving said liquid through said orifice and operating means responsive to liquid driven through said orifice for operating said valve means.

2. The wire line packer of claim 1 further characterized by delta pressure means operative to equalize the effect of well pressure on the resilient sleeve.

3. The wire line packer of claim 1 further characterized in that a pressure-temperature subassembly is connected to said elongated body.

4. The wire line packer of claim 1 further characterized in that a wire line jar assembly is connected to said elongated body.

5. The wire line packer of claim 1 further characterized in that said gas chamber means is formed inside said tubing section.

6. The wire line packer of claim 1 further characterized in that said valve means comprises a tubular member having a plurality of ports including an inflating gas inlet port, an inflating gas outlet port and a pressure sink port, a bridging piston having a portion of reduced diameter for selectively bridging (1) said gas inlet port and said gas outlet port and (2) said gas outlet port and said pressure sink port, and O-ring means for sealing the full diameter portion of said bridging piston and said tubular member to prevent bypass of gas except through said reduced diameter portion of said bridging piston.

7. The wire line packer of claim 6 further characterized in that said operating means includes a drive piston having an elongated stem connected to said bridging piston in said tubular member.

8. The wire line packer of claim 7 further characterized in that said drive piston is positioned in a cylinder, and that said cylinder has said orifice positioned intermediate its ends upstream of said drive piston, a free piston positioned upstream of said orifice, said noncompressible liquid in said cylinder between said free and said drive pistons, and means for supplying said operating gas means to move said free piston through said cylinder and force said liquid through said orifice and drive said drive piston through said cylinder.

9. In a wire line inflatable packer including an inflatable resilient sleeve, gas storage means for inflating said sleeve and means for supporting said sleeve and said gas storage means in an operating position on a wire line in a well, the improvement comprising conduit means connected between said gas storage means and said inflatable resilient sleeve; valve means on said conduit means for controlling flow through said conduit means to said resilient sleeve; sequencing timer actuating means for operating said valve means, said sequencing timer actuating means comprising a cylinder, an orifice in said cylinder, a noncompressible liquid in said cylinder upstream of said orifice, means for supplying an operating gas to said cylinder upstream of said orifice to move said liquid through said orifice and stem means downstream of said orifice, said stem means connected to said valve to operate said valve means on movement of said stem means, said stem means being moved in response to flow through said orifice.

10. The wire line inflatable packer of claim 9 further characterized in that said valve means comprises a tubular member having a plurality of ports including an inflating gas inlet port, an inflating gas outlet port and a pressure sink port, a piston having a portion of reduced diameter for selectively bridging (1) said gas inlet port and said gas outlet port and (2) said gas outlet port and said pressure sink port, and O-ring means for sealing the full diameter portion of said piston and said tubular member to prevent bypass of gas except through said reduced diameter portion of said piston.

* * * * *